United States Patent [19]

Killop et al.

[11] 4,453,353

[45] Jun. 12, 1984

[54] GUY WIRE PROTECTOR

[75] Inventors: Bradley V. Killop, Brighton; Robert R. Rogers, Rochester, both of Mich.

[73] Assignee: Robin Products Company, Farmington Hills, Mich.

[21] Appl. No.: 301,545

[22] Filed: Sep. 14, 1981

[51] Int. Cl.[3] ..... E04H 12/20; H01B 7/24

[52] U.S. Cl. ..... 52/147; 16/DIG. 13; 24/132 R; 52/728; 174/5 R; 174/136

[58] Field of Search ..... 52/147, 728; 24/115 R, 24/132 R; 174/5 R, 136; 16/DIG. 13

[56] References Cited

U.S. PATENT DOCUMENTS

| | | | |
|---|---|---|---|
| 1,517,846 | 12/1924 | Lewis | 52/728 X |
| 1,950,917 | 3/1934 | Fisher et al. | 52/147 |
| 3,428,742 | 2/1969 | Smith | 52/147 |
| 3,999,340 | 12/1976 | Bogese et al. | 52/147 |
| 4,231,208 | 11/1980 | Willox | 52/741 |

FOREIGN PATENT DOCUMENTS

| | | | |
|---|---|---|---|
| 1362680 | 4/1964 | France | 174/136 |

*Primary Examiner*—Alfred C. Perham

*Attorney, Agent, or Firm*—Cullen, Sloman, Cantor, Grauer, Scott & Rutherford

[57] ABSTRACT

A guy wire protector comprises an elongated tube having a pair of registering free edges to receive a guy wire. A generally tubular clip is integral with and extends from the tube interior wall snugly receives and retainingly engages the guy wire.

3 Claims, 4 Drawing Figures

GUY WIRE PROTECTOR

BACKGROUND OF THE INVENTION

1. Field of the Invention

Guy wire protectors have heretofore been employed to protectively enclose guy wires and or cable such as are used in conjunction with telephone poles and the like. The protectors being of an increased dimension with respect to the guy wire are more readily visible serving as a warning against impingement thereon by persons walking or in vehicles.

2. The Prior Art

Heretofore, various types of protective devices have been mounted upon the guy wires for protectively enclosing them and with some metallic clamping device or other securing device for anchoring the protective tube in place.

SUMMARY OF THE INVENTION

An important feature of the present invention is to provide a unitary guy wire protector generally tubular in form having a pair of registering free edges adapted to receive a guy wire together with a generally tubular clip means integral with and upon the interior of the protective tube to snugly receive and retainingly engage the guy wire.

A further feature is to provide a clip means which is generally tubular in shape which is upon and integral with the interior surface of the protective tube and which includes an clip end slot for receiving said guy wire.

A further feature includes two or more elongated clips mounted upon and extending from the interior surface of the protective tube, each clip having a guy wire entrance slot.

A further feature is to provide a protective tube and interior, generally tubular clip, or a plurality of spaced clips with the tube and clips made of a flexible plastic material.

These and other features will be seen from the following Specification and Claims in conjunction with the appended drawing.

THE DRAWING

It will be understood that the above drawing illustrates merely a preferred embodiment of the invention and that other embodiments are contemplated within the scope of the claims hereafter set forth.

DETAILED DESCRIPTION OF AN EMBODIMENT OF THE INVENTION

Figure 1:
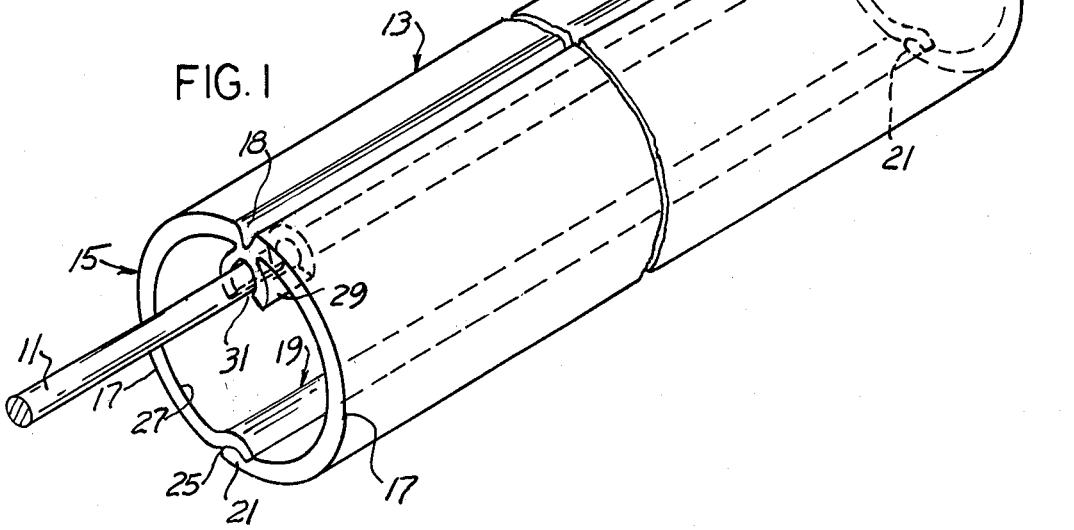
FIG. 1 is a fragmentary prospective view of a guy wire protector positioned around and secured to a guy wire, fragmentarily shown.
Figure 4:
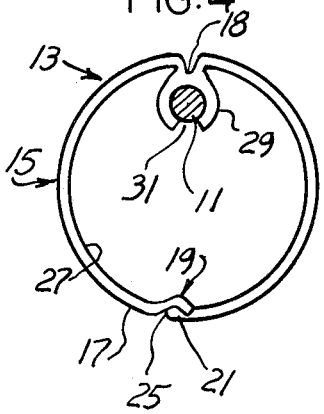
FIG. 4 is an end view of FIG. 1.
Figure 3:
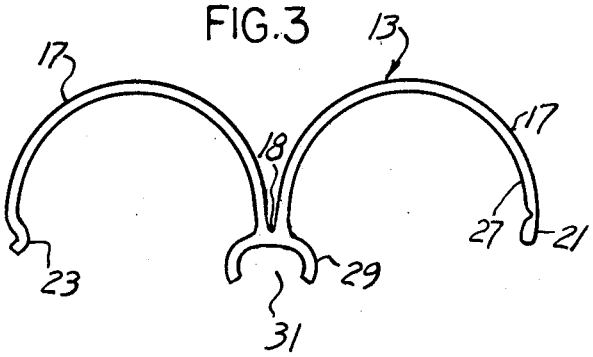
FIG. 3 is an end view of FIG. 2

Referring to the drawing, a guy wire or cable such as used for reinforcing a telephone post or the like is fragmentarily shown at 11 in FIG. 1 upon which is mounted the present guy wire protector 13.

Said protector includes an elongated tube 15, preferably of a plastic material, such as polypropylene or other flexible plastic material, which is molded initially into a pair of semi-cylindrical tube sections 17 which are integrally and flexibly interconnected longitudinally along the line of their juncture as at 18. The sections 17 are shown in FIG. 1 as formed into a cylindrical tube 15 having free longitudinal edges which are overlapped at 19 and interlocked after the tube sections 17 have been wrapped around guy wire 11.

The interlocking of the registering longitudinal overlapped distal edges of the tube sections includes an elongated bead 21 along the length of one section and an elongated outwardly opening arcuate edge 23 along the edge of the registering tube section. Said arcuate edge 23 defines an elongated locking recess 25 within which bead 21 is nested and interlocked retaining the tube in cylindrical form under tension. The elongated juncture 18 between the tube sections is of reduced thickness to provide a flexible connection therebetween.

Tube 15 has an inner surface 27. Projecting radially inward from said inner surface is a generally tubular outwardly opening clip means molded as an integral part of the tube sections 17 at their elongated flexible juncture or connection 18.

In the illustrative embodiment, the clip means is shown in the form of one or more longitudinally spaced molded elongated tubular clips 29 of C-shape projecting radially inward from inner surface 27 of tube 15 and spaced from the tube sections overlap 19, FIG. 1.

Figure 2:
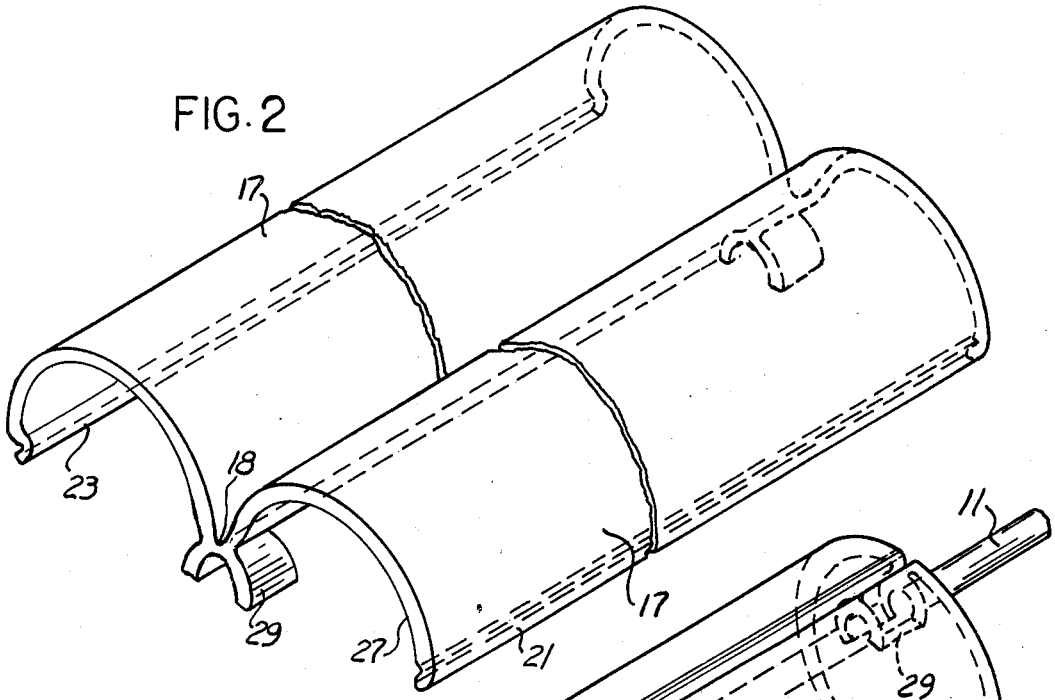
FIG. 2 is a perspective view of a guy wire protector and integral clips as molded and before forming an assembly around the guy wire shown in FIG. 1.

The clip means or elongated tubular clips 29 each have an entrant slot 31 which is laterally enlarged and is initially formed either by molding or extrusion, FIG. 2. Said clip takes the form shown in FIG. 1 when the semi-cylindrical tube sections 17 are rotated from the shape shown in FIG. 2, to the tubular shape shown in FIG. 1. Here, the entrant slots 31 have received and the clips are secured around a substantial portion of guy wire 11.

The clip means 29 are for the purpose of anchoring the tube 15 to the guy wire and to prevent relative longitudinal movement thereof with respect to said guy wire.

In view of the inherent resiliency of the tube sections 17, being of plastic, either molded or extruded, when the tube sections are formed into a single cylindrical tube 15 interlocked between the elongated overlapped free edges thereof as at 19, there is defined a self lock between said sections completing the protective tube shown in FIG. 1.

The guy wire protector 13 is initially molded or extruded to the form shown in FIG. 2. The tube sections 17 comprise integral semi-cylindrical plastic sheets flexibly jointed along the line 18. The clip means are of C-shape in the illustrative embodiment and are integral with the tube sections at their flexible connection 18.

When the sections 17 are rotated together to surround guy wire 11, and their distal edges interlock at 19, the integral clips are simultaneously formed so as to receive and operatively enclose said guy wire.

The guy wire protector also protects an individual contacting the wire by providing a resilient pad. It can be made of brightly colored plastic or of a luminescent plastic to provide visible warning of the location of the wire, for joggers, skiers, or snowmobiles for illustration.

Having described our invention, reference should now be had to the following claims:

We claim:

1. A wire protector and guard integrally fabricated from a flexible plastic material, comprising: an elongated outer tubular portion defined by a pair of semi-cylindrical tube sections integrally joined along a longitudinal axis by a flexible hinge connection defined by a longitudinal junction between said semi-cylindrical tube sections having a reduced thickness providing a resilient integral flexible hinge, and said tube sections having opposed free edges adapted to receive and enclose a wire, and an integral generally C-shaped clip means having a radius smaller than said outer tubular portion comprised of a pair of adjacent arcuate portions integrally joined to the inner surface of said tubular portion on opposed sides of said flexible hinge connection, said clip means having opposed free edges opening generally toward said tubular sections free ends, whereby opening said tubular portion about said flexible hinge connection opens said C-shaped clip means to receive a wire therein, and closing said tubular portion closes said clip means to securely retain said wire.

2. The protector and guard defined in claim 1, characterized in that said flexible hinge connection is defined by a longitudinal groove in the outer surface of said outer tubular portion.

3. The wire protector and guard defined in claim 1, characterized in that said tube sections free edges each include a mating locking means adapted to lock said semi-cylindrical tube sections in a tubular form upon rotation of said sections about said flexible hinge connection into abutting engagement.

* * * * *